US007727019B2

(12) United States Patent
Droesbeke et al.

(10) Patent No.: US 7,727,019 B2
(45) Date of Patent: Jun. 1, 2010

(54) SHELL FOR CIRCUIT BOARD CONNECTOR

(75) Inventors: Gert Droesbeke, Geel (BE); Robert Van Den Heuvel, Appeltern (NL); Nico Van Stiphout, Beek en Donk (NL); Bernard Vuillaume, Chevigney-sur-l'Ognon (FR); Michel Fonteneau, Le Mans (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/223,504

(22) PCT Filed: Jan. 30, 2006

(86) PCT No.: PCT/EP2006/001691

§ 371 (c)(1),
(2), (4) Date: Dec. 8, 2008

(87) PCT Pub. No.: WO2007/085273

PCT Pub. Date: Aug. 2, 2007

(65) Prior Publication Data

US 2009/0186525 A1 Jul. 23, 2009

(51) Int. Cl.
*H01R 13/648* (2006.01)

(52) U.S. Cl. ..... 439/607.35; 439/607.54

(58) Field of Classification Search ..... 439/607.35, 439/607.54, 607.01

See application file for complete search history.

(56) References Cited

U.S. PATENT DOCUMENTS 5,266,038 A 11/1993 Nakamura ..... 439/79
5,980,320 A 11/1999 Slack et al. ..... 439/607
6,007,381 A 12/1999 Ando et al. ..... 439/607
6,027,375 A * 2/2000 Wu ..... 439/607.02
6,203,336 B1 3/2001 Nakamura ..... 439/80
6,213,813 B1 4/2001 Huang ..... 439/607
6,224,422 B1 5/2001 Zhu et al. ..... 439/607
6,612,868 B2 * 9/2003 Hwang ..... 439/607.54

(Continued)

FOREIGN PATENT DOCUMENTS

EP 0497165 A1 8/1992
EP 0671785 A1 9/1995
EP 1369958 A1 12/2003

*Primary Examiner*—Gary F. Paumen
(74) *Attorney, Agent, or Firm*—Harrington & Smith

(57) ABSTRACT

The invention relates to a circuit board connector capable of establishing an electrical connection between circuits on a circuit board and a mating electrical connector at a mating side of said circuit board connector. The circuit board connector includes a connector housing accommodating a plurality of terminals for establishing said electrical connection and an electrically conductive shell at least partially enclosing said connector housing. The shell includes a top wall and a rear wall, wherein said rear wall is connected to said top wall and is arranged opposite to said mating side. The shell further has a first and second extension connected to opposite sides of said rear wall and bent with respect to said rear wall to extend towards said mating side. First and second mounting posts are connected, respectively, to said first and second extension and third and fourth mounting posts are connected to said rear wall, wherein said mounting posts are arranged for mounting said shell on said circuit board.

29 Claims, 10 Drawing Sheets

U.S. PATENT DOCUMENTS 6,733,339 B2 * 5/2004 Casey ..... 439/607.35
7,001,216 B1 * 2/2006 Huang ..... 439/607.54
7,008,266 B2 * 3/2006 Fang ..... 439/607.35
7,029,331 B1 * 4/2006 Lai ..... 439/607.35
7,182,641 B2 * 2/2007 Shimoyama ..... 439/607.35
2005/0282424 A1 12/2005 Huang et al. ..... 439/353

* cited by examiner

SHELL FOR CIRCUIT BOARD CONNECTOR

FIELD OF THE INVENTION

Generally, the invention relates to the field of electrical connectors, in particular circuit board connectors capable of establishing an electrical connection between circuits on a circuit board and a mating electrical connector. More specifically, the invention relates to an electrically conductive shell of a circuit board connector at least partially enclosing a connector housing of such a connector.

BACKGROUND OF THE INVENTION

Circuit board connectors typically include an insulative connector housing accommodating a plurality of terminals for establishing an electrical connection between circuits on a circuit board and a mating electrical connector.

The connector housing is at least partially enclosed by an electrically conductive shell of the circuit board connector for electromagnetic shielding purposes. The electrically conductive shell is mounted on the circuit board by mounting posts. The mounting posts serve to mount the shell on the circuit board. The shell provides a reference for the connector housing accommodating the terminals. Furthermore, the mounting posts are in contact with contact pads of a grounding circuit of the circuit board in order to convey electromagnetic interference signals away from the connector. The latter function is essential in order to avoid disturbance of the electrical signals carried by the terminals of the circuit board connector and to preserve the integrity of these signals.

There is a need for a circuit board connector comprising an electrically conductive shell with improved electromagnetic shielding characteristics.

SUMMARY OF THE INVENTION

A circuit board connector is provided that is capable of establishing an electrical connection between circuits on a circuit board and a mating electrical connector at a mating side of said circuit board connector. The circuit board connector comprises a connector housing accommodating a plurality of terminals for establishing said electrical connection and an electrically conductive shell that at least partially encloses said connector housing. The shell comprises a top wall and a rear wall, wherein said rear wall is connected to said top wall and is arranged opposite to said mating side. A first and a second extension of the shell are connected to opposite sides of said rear wall and bent with respect to said rear wall to extend towards said mating side. The shell has a first and a second mounting post connected, respectively, to said first and second extension and third and fourth mounting posts connected to said rear wall. The mounting posts are arranged for mounting said shell on said circuit board.

The top wall, rear wall, extensions and mounting posts may be formed from a single metal plate to form an integral whole. By providing mounting posts both at the rear wall and at the extensions, a nearby ground connection via the mounting posts to the grounding circuits of the circuit board is available for each position on the shell. Consequently, electromagnetic interference signals picked up by the shell can be quickly transferred to the grounding circuits in the circuit board to provide an improved electromagnetic shielding performance and the integrity of the signals transferred via the terminals can be preserved. The invention may e.g. be applicable to unified display interfaces (UDI).

The embodiment of the invention as defined in claim 2 has the advantage that the sidewalls increase the electromagnetic shielding performance of the shell. Preferably, the sidewalls are connected to the top wall and a bottom wall of the shell to enclose the connector housing. The sidewalls and bottom wall may also be obtained from the single metal plate that provides the top wall, rear wall, extensions and mounting posts.

As the shell may be formed from a single metallic plate by bending, the embodiment of the invention as defined in claim 3 provides for a mechanical connection to preserve the shape of the shell in an operating state. The interaction structures may further serve to provide electrical contact between the sidewalls and the extensions of the rear wall to allow adequate transfer of electromagnetic interference signals from the top wall to the extensions and further to the first and second mounting posts.

The embodiment of the invention as defined in claim 4 may facilitate mounting of the extensions to the sidewalls or top wall and may assist in preserving the shape of the shell in an operating state.

The embodiment of the invention as defined in claim 5 ensures that a maximum contact pressure is obtained between the extensions and the corresponding sidewalls. If the protrusion is received in a corresponding opening of a sidewall, as defined in the embodiment of claim 6, and the extensions exert a contact force in the direction of the protrusions, the shape of the shell can be preserved without hooking or latching the extensions to another part of the shell. In another embodiment without such an opening, the protrusion may provide a certain distance between the extension and a corresponding sidewall to facilitate locking of the extension to the sidewall.

Whereas in the embodiment defined in claim 6, manipulation of the extensions, e.g. by a mating connector, may result in the extensions loosing contact with the sidewalls, the embodiment of the invention as defined in claim 7 provides for a locking arrangement to guarantee preservation of the shell shape for any practically realistic manipulation of the shell. The embodiment of the invention as defined in claim 8 provides for locking of the extensions only when the extensions are in the correct position.

The embodiment of the invention as defined in claim 9 provides for a more convenient locking structure and for a shell of reduced height.

The embodiment of the invention as defined in claim 10 provides an alternative solution for preserving the shape of the shell, wherein the locking element is positioned on the sidewalls. The embodiments as defined in claims 11 and 14 provide for a robust electrically conductive shell. The embodiment of claim 12 prevents that a protruding locking element would interfere with the mating interface of the connector. The recess provides room for immediate backward bending of the locking element. This bending and subsequent locking is facilitated by the shape of the recess, as defined in claim 13.

It should be appreciated that, in addition to or instead of the above-defined embodiments, the extensions may be connected to the remainder of the shell in a permanent fashion, as is defined in claim 15.

The embodiment of the invention as defined in claim 16 provides a polarization feature for the shells. E.g. for UDI application, one distinguishes between source connectors and sink connectors and said polarization feature may prevent erroneous application of such connectors. The presence of the third and fourth mounting posts at the rear wall instead of at the extensions facilitates this embodiment, since the distance at the rear wall between the third and fourth mounting posts can be selected freely.

The embodiment of the invention as defined in claim 17 facilitates positioning of the shell on the circuit board and reduces rotational freedom of the shell with respect to the board. Rotation freedom may be reduced if the mounting posts are solder tails or press-fit tails.

The embodiment of the invention as defined in claim 18 facilitates alignment of the shell with respect to the circuit board.

The embodiment of the invention as defined in claim 19 allows heat dissipation into and out of the shell for mounting the shell on the circuit board in a reflow process, respectively, exhausting heat during operation of the connector. Furthermore, the openings enable escape of gasses originating from solvents of the paste used in the reflow mounting process. Any opening in the shell is an obstruction that will divert the electromagnetic interference signal and increase the path of the current which introduce an excess impedance and hence a voltage drop across the opening. The wider the slot (direction perpendicular to the undisturbed flow of the current), the greater the voltage drop. This drop will induce an electromagnetic field in the slot and causes it to radiate. The embodiment minimizes this effect by positioning the long axis of the opening parallel to the current path and positioning the openings at substantially equidistant positions.

The embodiment of the invention as defined in claim 20 allows for accurate positioning of the first and second mounting posts after bending of the rear wall and the top wall with respect to each other. The bending relief or bending structure facilitates bending at a predetermined location.

In another aspect of the invention, a circuit board connector capable of establishing an electrical connection between circuits on a circuit board and a mating electrical connector at a mating side of said circuit board connector is provided. The circuit board connector comprises a connector housing accommodating a plurality of terminals for establishing said electrical connection and an integrate electrically conductive shell at least partially enclosing said connector housing. The integrate shell comprises a top wall, opposing sidewalls and a rear wall, wherein said sidewalls and said rear wall are connected to said top wall and wherein said rear wall is arranged opposite to said mating side and said side walls extend substantially in a direction between said rear wall and said mating side. The shell further has a first and second extension connected to opposite sides of said rear wall and bent with respect to said rear wall to extend towards said mating side substantially parallel to said corresponding sidewalls, wherein said first and second extension are capable to cooperate with at least one of said top wall and said sidewalls. First and second mounting posts of the shell are connected, respectively, to said first and second extension and third and fourth mounting posts are connected to said rear wall, wherein said mounting posts are arranged for surface mounting said connector on said circuit board.

The top wall, rear wall, sidewalls, extensions and mounting posts are formed from a single metal plate to form an integral whole. By providing mounting posts both at the rear wall and at the extensions, a nearby ground connection via the mounting posts to the grounding circuits of the circuit board is available for each position on the shell. Consequently, electro-magnetic interference signals picked up by the shell can be quickly transferred to the grounding circuits in the circuit board to provide an improved electromagnetic shielding performance and the integrity of the signals transferred via the terminals can be preserved.

In yet another aspect of the invention, a circuit board connector capable of establishing an electrical connection between circuits on a circuit board and a mating electrical connector at a mating side of said circuit board connector is provided. The circuit board connector comprises a connector housing accommodating a plurality of terminals for establishing said electrical connection and an electrically conductive shell at least partially enclosing said connector housing. The shell comprises a top wall, opposing sidewalls and a rear wall, wherein said sidewalls and said rear wall are connected to said top wall, wherein said rear wall is arranged opposite to said mating side and said side walls extend substantially in a direction between said rear wall and said mating side. The shell further has a first and second extension connected to opposite sides of said rear wall and bent with respect to said rear wall to extend towards said mating side substantially parallel to said corresponding sidewalls, wherein said first and second extension are capable to cooperate with at least one of said top wall and said sidewalls. First and second mounting posts of the shell are connected, respectively, to said first and second extension and third and fourth mounting posts are connected to said rear wall, wherein said mounting posts are arranged for surface mounting said connector on said circuit board. The mounting posts are flat and define major surfaces for said mounting posts. A first normal direction of said major surfaces of said first and second mounting posts is substantially orthogonal to a second normal direction of said major surfaces of said third and fourth mounting posts.

The top wall, rear wall, sidewalls, extensions and mounting posts may be formed from a single metal plate to form an integral whole. By providing mounting posts both at the rear wall and at the extensions, a nearby ground connection via the mounting posts to the grounding circuits of the circuit board is available for each position on the shell. Consequently, electro-magnetic interference signals picked up by the shell can be quickly transferred to the grounding circuits in the circuit board to provide an improved electromagnetic shielding performance and the integrity of the signals transferred via the terminals can be preserved. The orthogonal orientation of the first and second mounting post with respect to the third and fourth mounting post facilitates positioning of the shell on the circuit board and reduces rotational freedom of the shell with respect to the board In another aspect of the invention, an electrically conductive shell is provided for use in a circuit board connector as described above.

In still another aspect of the invention, a method of manufacturing an electrically conductive shell is provided comprising a top wall, opposing sidewalls and a rear wall. The sidewalls and said rear wall are connected to said top wall and a first and second extension are connected to opposite sides of said rear wall. The first and second extension respectively comprise a first and second mounting post and said rear wall comprises third and fourth mounting posts for mounting said shell on a circuit board. The method comprises the steps of bending said top wall and rear wall with respect to each other such that said rear wall is oriented substantially orthogonal to said top wall and bending said first and second extension with respect to said rear wall such that said first and second extension extend substantially parallel along said corresponding sidewalls.

The top wall, rear wall, sidewalls, extensions and mounting posts may be formed from a single metal plate to form an integral whole. By providing mounting posts both at the rear wall and at the extensions, a nearby ground connection is available for each position on the shell. Consequently, electromagnetic interference signals picked up by the shell can be quickly transferred to the grounding circuits in the circuit board to provide an improved electromagnetic shielding performance and the integrity of the signals transferred via the terminals can be maintained.

The merits of the embodiments of claims 25-29 correspond to those recited above with respect to claims 4, 7, 10, 15 and 20 respectively.

Finally, in an aspect of the invention a method is provided capable of manufacturing an electrically conductive shell as defined above from a metal sheet by stamping and, preferably, bending.

It should be noted that the above aspects and embodiments may be combined.

The invention will be further illustrated with reference to the attached drawings, which schematically show a preferred embodiment according to the invention. It will be understood that the invention is not in any way restricted to this specific and preferred embodiment.

DETAILED DESCRIPTION OF THE DRAWINGS

Figure 1:
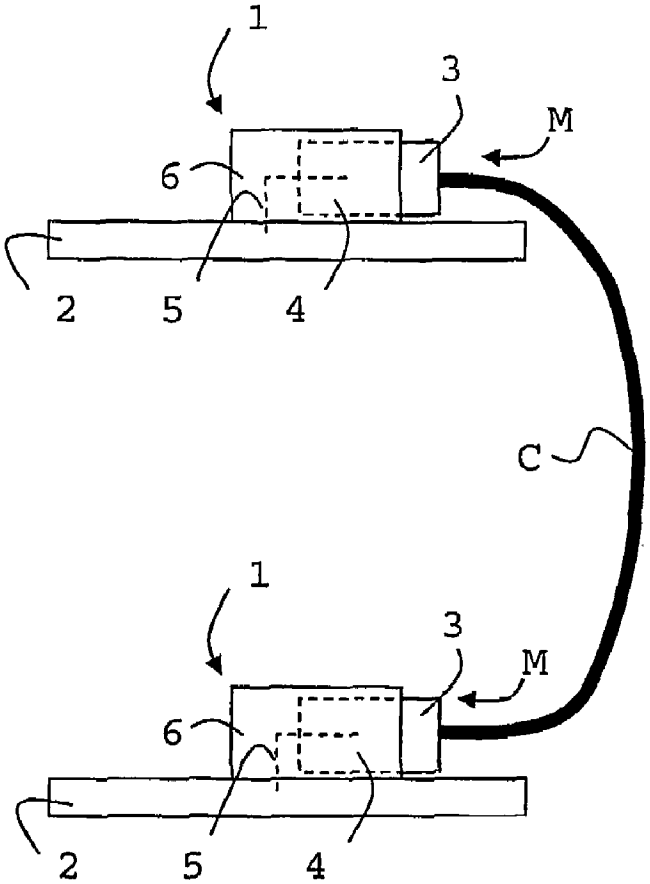
FIG. 1 is a schematic illustration of a connector system comprising circuit board connectors according to an aspect of the invention.

FIG. 1 is a schematic illustration of a connector system comprising circuit board connectors 1, hereinafter also referred to as board connectors, mounted on corresponding circuit boards 2. Such a connector system may e.g. be applied for a unified display interface, wherein one of the connectors 1 is referred to as a source connector and the other connector is referred to as a sink connector. The connectors 1 are connected via a cable C.

The circuit board connector 1 is capable of establishing an electrical connection between circuits (not shown) on the circuit board 2 and a mating electrical connector 3 at a mating side M of the circuit board connector 1. The circuit board connector comprises a connector housing 4 accommodating a plurality of terminals 5, only one of which is schematically shown in FIG. 1, for establishing the electrical connection between the mating connector 1 and the circuit board 2. The board connector 1 comprises a one-piece (integrate) electrically conductive shell 6 capable of enclosing the connector housing 4.

Figure 2:
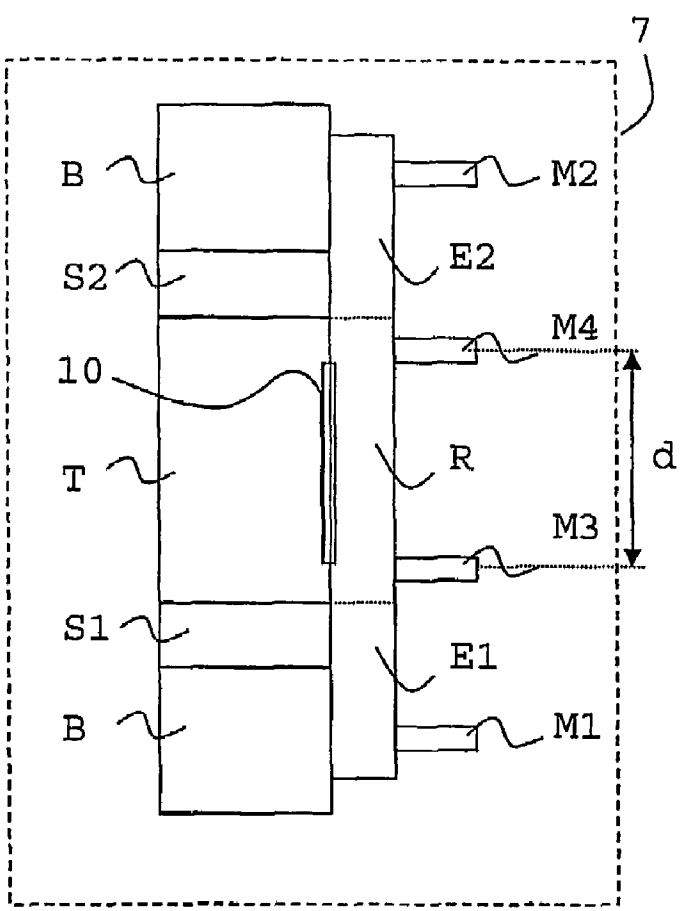
FIG. 2 is a schematic illustration of a planar metal plate capable of being shaped to form an electrically conductive shell according to an aspect of the invention.

FIG. 2 is a schematic illustration of a planar metal plate 7 capable of being shaped to form the one-piece electrically conductive shell 6 according to an aspect of the invention. The metal plate 7 of FIG. 2 may be shaped from a metal plate by stamping.

The metal plate 7 is capable of forming the electrically conductive shell 6 comprising a top wall T, a rear wall R, sidewalls S1, S2, bottom wall parts B, a first extension E1, a second extension E2, a first mounting post M1, a second mounting post M2, a third mounting post M3 and a fourth mounting post M4 that form an integral whole. The top wall T is connected to the rear wall R and to the sidewalls S1, S2. Furthermore, the first and second extension E1, E2 are connected to opposite sides of the rear wall R. In FIG. 2, the first and second extension E1, E2 are not connected to the bottom wall parts B or the sidewalls S1, S2. The first and second mounting posts M1, M2 are connected, respectively, to the first and second extension E1, E2 and the third and fourth mounting posts M3, M4 are connected to the rear wall R. The mounting posts are arranged for mounting the shell 6 on the circuit board 2.

As will be described further with reference to the embodiments of FIGS. 3A-3C, FIGS. 4A-4D, FIGS. 5A-5F, FIGS. 6A-6D and FIGS. 7A-7D, the rear wall R may be arranged opposite to the mating side M of the board connector 1 by bending the rear wall R with respect to the top wall T. This bending process may be facilitated by a bending profile 10 arranged between the top wall T and rear wall R. In order to form the shell 6 according to an aspect of the invention, the first extension E1 may be bent with respect to the rear wall R such that the first extension E1 extends along a corresponding sidewall S1. Similarly, the second extension E2 may be bent with respect to the rear wall R such that the second extension E2 extends along a corresponding sidewall S2. In this state, the first and second mounting posts M1, M2 are positioned near the mating side M of the connector, whereas the third and fourth mounting posts M3, M4 are positioned at the rear wall R of the board connector 1.

It should be appreciated that, in the case where a bottom wall part B is not provided with the shell, the sidewalls S1, S2 may be omitted and the extensions E1 and E2 may serve as sidewalls. The extensions E1, E2 may e.g. be locked by a suitable arrangement of the top wall T. However, sidewalls S1, S2 increase the electromagnetic shielding performance and may be structured to lock with corresponding structures of the extensions E1, E2.

By providing mounting posts M1, M2 at the extensions E1 and E2 and mounting posts M3, M4 at the rear wall R, a nearby ground connection via these mounting posts M1, M2, M3, M4 to the grounding circuits of the circuit board 2 is available for each position on the shell 6. Consequently, electromagnetic interference signals picked up by the shell 6 can be quickly transferred to the grounding circuits in the circuit board 2 to provide an improved electromagnetic shielding performance for the board connector 1 and the integrity of the signals transferred via the terminals 5 can be preserved.

In aspect of the invention, the distance d between the third and fourth mounting post M3, M4 can be freely selected, whereas the distance between the mounting posts M1, M2 is in principle determined by the width of the top wall T. This feature can be used to advantage for polarization purposes, e.g. for distinguishing between the source connector and sink connector in UDI application, shown in FIG. 1.

Next, with reference to FIGS. 3A-3C, FIGS. 4A-4D, FIGS. 5A-5F, FIGS. 6A-6D, FIGS. 7A-7D, FIGS. 8A-8C, FIGS. 9A-9C and FIGS. 10A-10C, seven embodiments of the invention will be described. Identical reference numerals indicate identical or similar features of the board connector 1.

In all embodiments, the top wall T and bottom wall parts B comprise latches 11 capable of contacting the mating connector 3.

Furthermore, the top wall T is connected to the rear wall R by a plurality of connecting elements 12 separated by equidistant openings 13. The material thickness of the connecting elements 12 is less than that of the top wall T and rear wall R in order to create the bending profile 10 (FIG. 2) that accurately defines the location where the top wall T and the rear wall R are supposed to bend with respect to each other. The openings 13 have a heat dissipation function. The openings 13 are located at equidistant positions in order to minimize the influence on electromagnetic interference signals running from the top wall T via the rear wall R towards the mounting posts M3, M4. For similar reasons, the edges of the openings 13 have rounded corners.

As the shell 6 is manufactured of a substantially flat metal sheet, the mounting posts M1, M2, M3, M4 are substantially flat and define major surfaces S for said mounting posts. After bending of the extensions E1, E2 with respect to the rear wall R, a first normal direction N1 of the major surfaces S of said first and second mounting posts M1, M2 are substantially orthogonal to a second normal direction N2 of the major surfaces S of said third and fourth mounting posts M3, M4. The orthogonal orientation of the mounting posts M1, M2 versus M3, M4 facilitates positioning of the shell 6 on the circuit board 2 and reduces rotational freedom of the shell 6 with respect to the circuit board 2.

It should be noted that the major surfaces S of the mounting posts are not or should not necessarily remain flat. As an example, the major surfaces may be curved or provided with alignment structures to facilitate positioning of the board connector 1 on the circuit board 2, as will be described with reference to FIGS. 9A-9C for another embodiment of the invention.

Figures 3A, 3B, 3C:
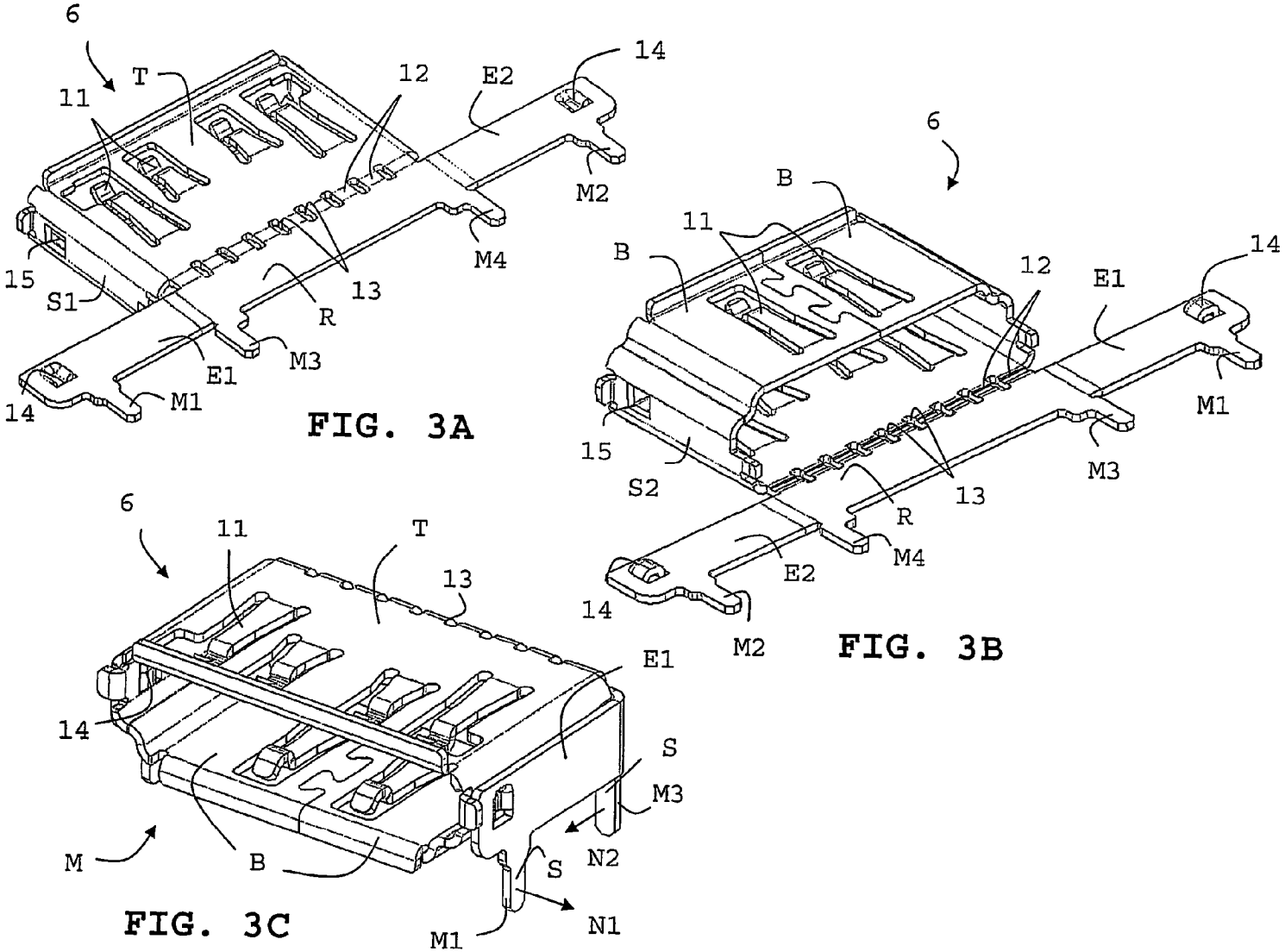
FIGS. 3A-3C show an electrically conductive shell of a circuit board connector according to a first embodiment of the invention.

FIGS. 3A-3C depict an electrically conductive shell 6 of a board connector according to a first embodiment of the invention. FIGS. 3A and 3B show the shell 6 before bending of the rear wall R and the first and second extension E1, E2, whereas FIG. 3C shows the shell 6 after bending the same.

The first and second extension E1, E2 comprise protrusions 14. The sidewalls S1, S2 comprise corresponding openings 15 that are capable of receiving protrusions 14. In FIG. 3C, the protrusions 14 extend in or through the openings 15. Preferably, the extensions E1, E2 are manufactured such that they are capable of exerting a contact force F in the direction of the sidewalls. The interference between the protrusions 14 and openings 15 assists in preserving the shape of the shell 6. More specifically, the attachment of the extensions E1, E2 to the remainder of the shell 6 is facilitated by the interference of the protrusions 14 and openings 15.

FIGS. 4A-4D illustrate a sequence of manufacturing steps for manufacturing the circuit board connector 1 comprising the electrically conductive shell 6 of the first embodiment.

Figure 4B:
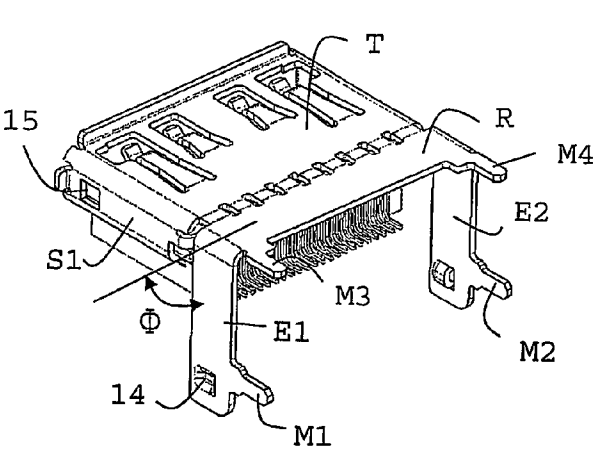
FIGS. 4A-4D show steps of a manufacturing sequence for a circuit board connector according to a first embodiment of the invention.
Figure 4A:
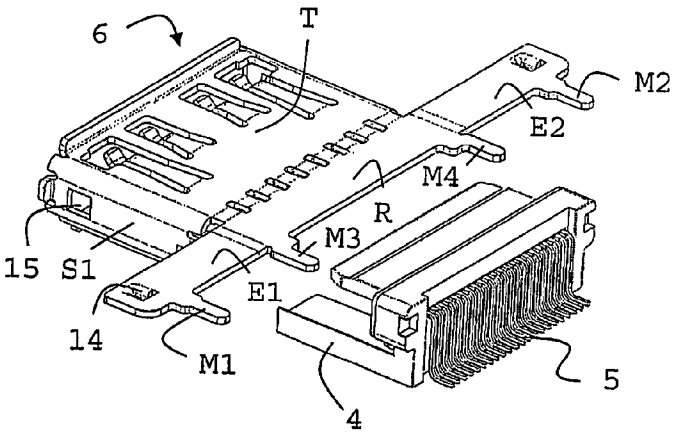

In FIG. 4A, the connector housing 4 accommodating the terminals 5 and the electrically conductive shell 6 are provided to assembly the board connector 1.

In FIG. 4B, the first and second extension E1, E2 are bent with respect to the rear wall R. The bending angle Φ preferably exceeds 90 degrees to enable the extensions E1 and E2 to develop the contact force F described above.

Figure 4D:
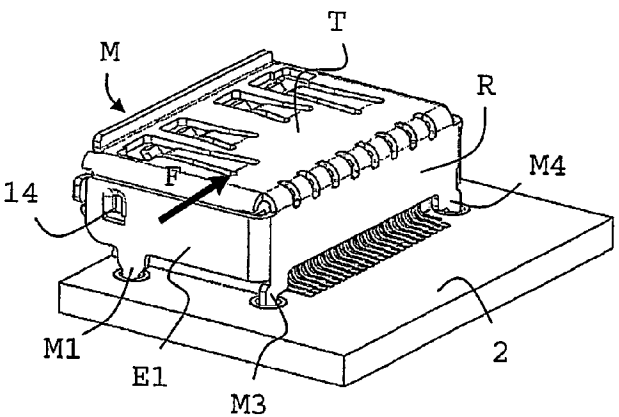
Figure 4C:
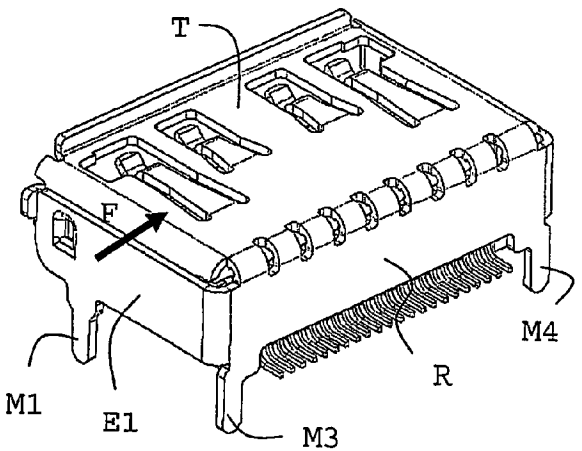

In FIG. 4C, the rear wall R is bent with respect to the top wall T at the connecting elements 12 until the rear wall R and top wall T have a substantially orthogonal orientation. In this position, the rear wall R is arranged opposite to the mating side M of the board connector 1.

Furthermore, as the extensions E1, E2 are connected to and bent with respect to the rear wall R, the extensions E1, E2 extend towards the mating side M of the board connector 1 and substantially parallel to the corresponding sidewalls S1, S2. Since the extensions E1, E2 were bent over a bending angle Φ exceeding 90 degrees, the extensions E1, E2 develop a contact force by the interaction between the extensions E1, E2 and the corresponding sidewalls S, S2. The protrusions 14 snap automatically into the corresponding openings 15 on moving the extensions E1, E2 over the sidewalls S1, S2 and assist in preserving the shell 6 in the state of FIG. 4C.

Finally, in FIG. 4D, the board connector 1 is mounted on the circuit board 2. This process step may involve a reflow process, known in the art, wherein the mounting posts M1, M2, M3, M4 and the terminals 5 are mounted to corresponding holes and pads of the circuit board. In this state, the board connector 2 is ready to establish an electrical connection between the circuit board 2 and a mating connector 3.

The further embodiments of the invention defined in FIGS. 5A-5F, FIGS. 6A-6D, FIGS. 7A-7D, FIGS. 8A-8C, FIGS. 9A-9C and FIGS. 10A-10C differ primarily from the first embodiment described above in the attachment of the first and second extension E1, E2 to the remainder of the electrically conductive shell 6. Consequently, the description of these further embodiments will focus on this feature.

In the second and third embodiment of the invention, shown respectively in FIGS. 5A-5F and FIGS. 6A-6D, the extensions E1, E2 are preferably not bent to develop a contact force F.

In the second embodiment of the invention, depicted in FIGS. 5A-5F, the first and second extension E1, E2 comprise protrusions 14. However, in contrast to the previously discussed embodiment of FIGS. 3A-3C and FIGS. 4A-4D, the sidewalls S1, S2 do not contain openings for receiving the protrusions 154. Consequently, when the extensions E1, E2 are bent towards the mating side M of the board connector 1, a slit remains between the sidewalls S1, S2 and the corresponding extensions E1, E2.

The extensions E1, E2 further comprise a recess 16 and an opening 17. The recess 16 and opening 17 are most clearly shown in the detailed schematic illustration of FIG. 5E. The recess 16 comprises an alignment portion 18 and a fixation portion 19 as will be further described with reference to FIG. 5F.

Figure 5A:
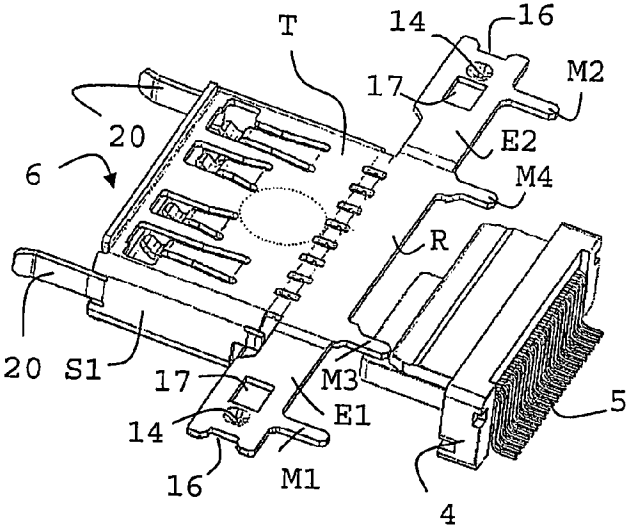
FIGS. 5A-5F show steps of a manufacturing sequence for a circuit board connector according to a second embodiment of the invention and details thereof.
Figure 5B:
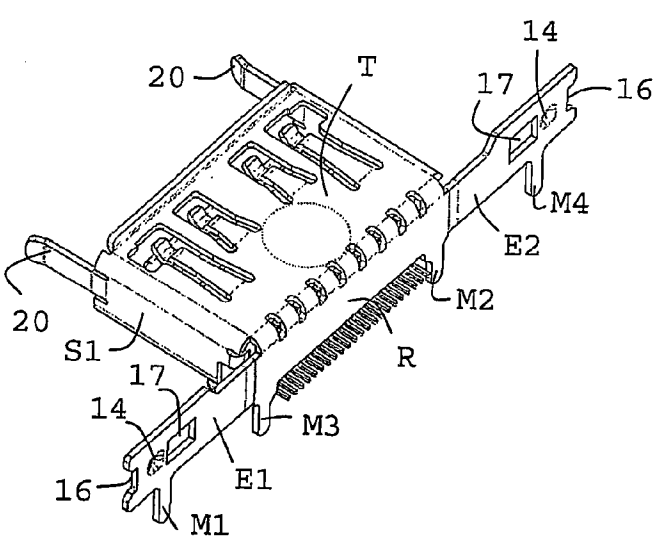
Figure 5C:
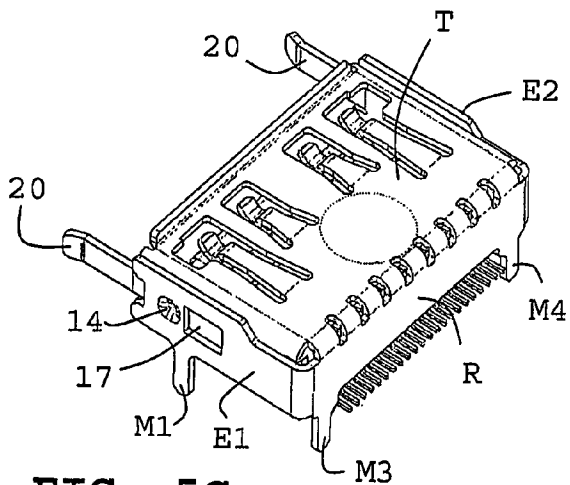
Figure 5D:
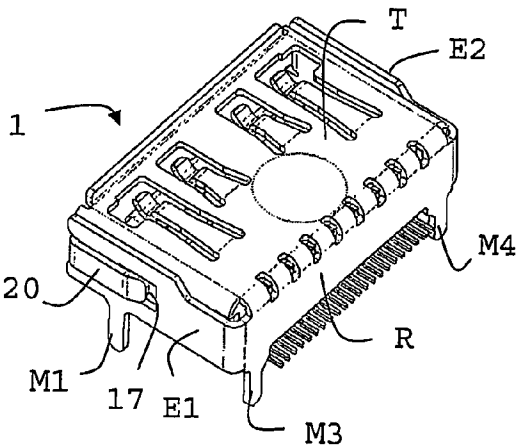
Figure 5F:
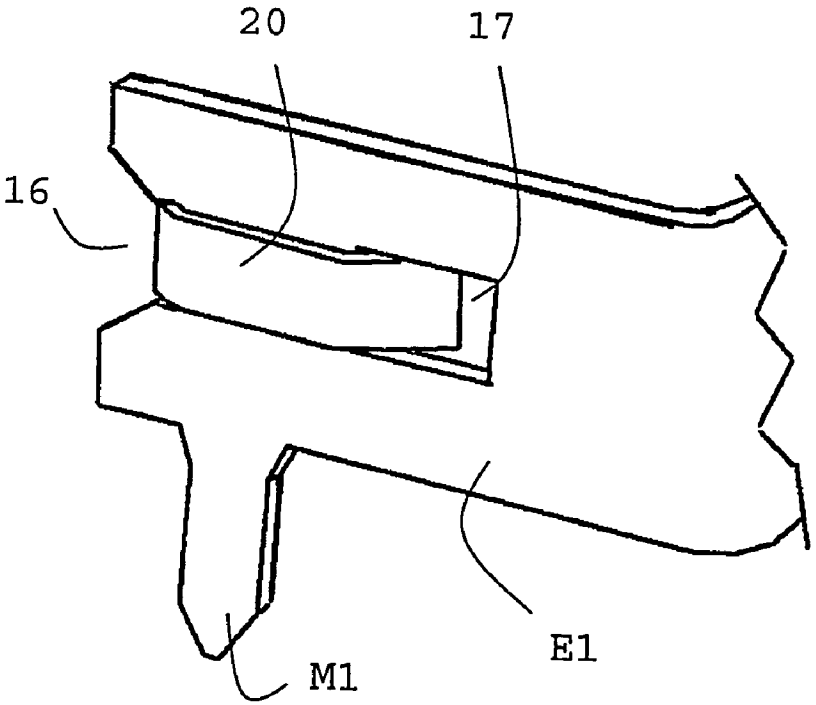
Figure 5E:
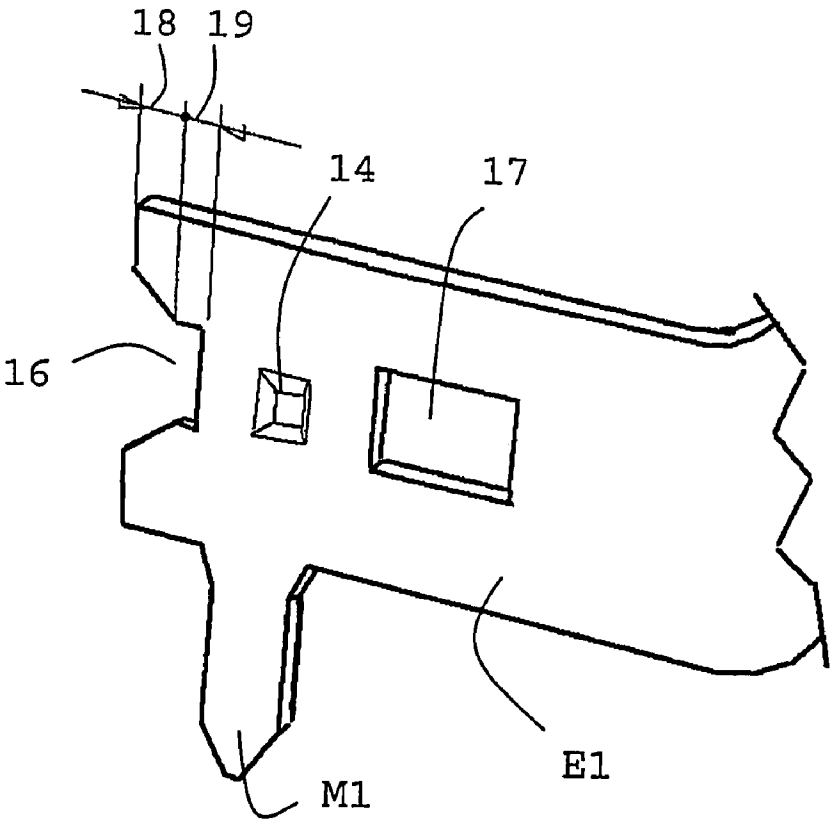

The sidewalls S1, S2 have locking elements 20 capable to extend substantially from the mating side M towards the rear wall R. However, before locking of the extensions E1, E2 by the locking elements 20, the locking elements 20 extend from the sidewalls S1, S2 towards the mating side. After bending of the extensions E1, E2 with respect to the rear wall R, shown in FIG. 5C, the locking elements 20 are forced backwards to make a U-turn, shown in FIG. 5D and, in detail, in FIG. 5F. During this last stage, the locking elements 20 are received in the recesses 16 such that the mating interface of the board connector is not disturbed by the locking elements 20. The recess 16 guides a corresponding locking element 20 by the alignment portion 18 towards the fixation portion 19. The height of the fixation portion 19 is smaller than the corresponding dimension of the locking element 20 such that a press-fit connection is obtained. In this state, the tip portion of the locking element 20 is capable of being forced through the opening 17 of the extension E1, E2. As shown in FIG. 5C, the tip portion may be pre-bend with respect to the remainder of the locking element 20. The presence of the slit between the extensions E1, E2 and their corresponding sidewalls S1, S2 allows the tip portion to at least partially protrude through the opening to establish a secure connection.

Figure 6B:
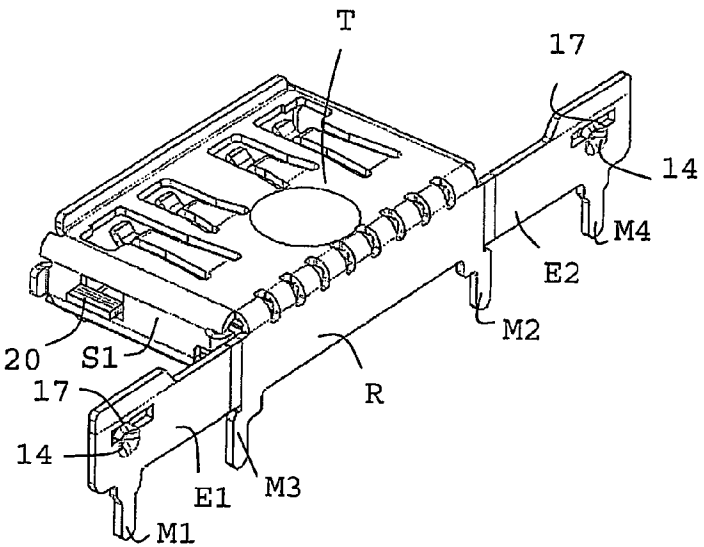
FIGS. 6A-6D show steps of a manufacturing sequence for a circuit board connector according to a third embodiment of the invention.
Figure 6D:
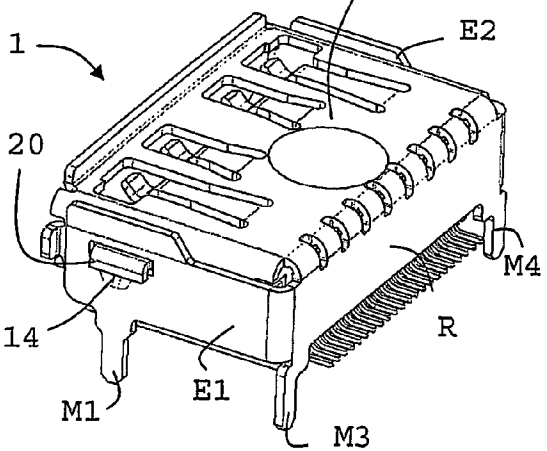
Figure 6A:
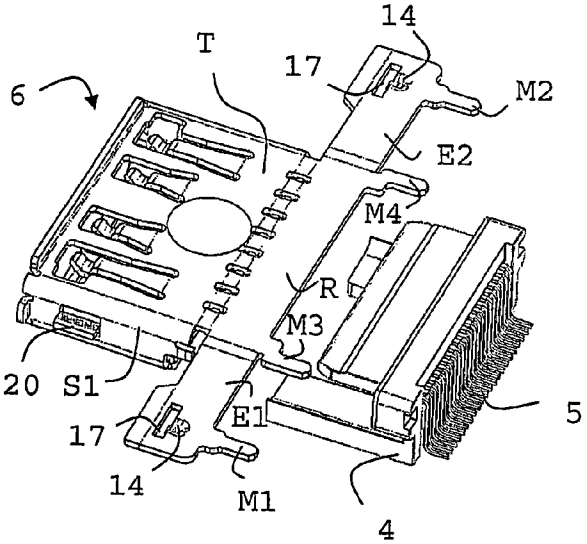
Figure 6C:
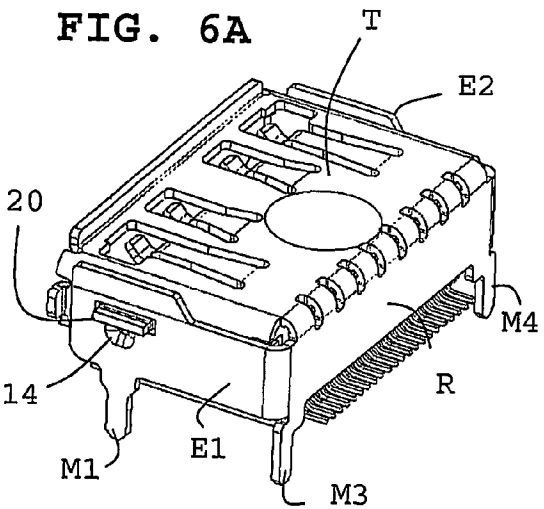
Figure 7B:
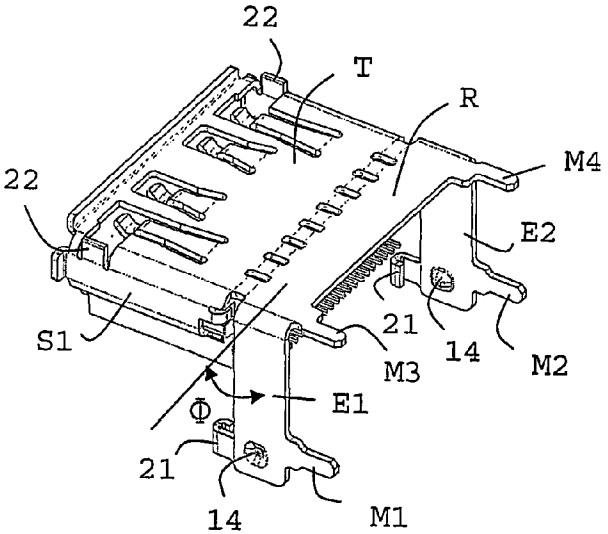
FIGS. 7A-7D show steps of a manufacturing sequence for a circuit board connector according to a fourth embodiment of the invention.
Figure 7D:
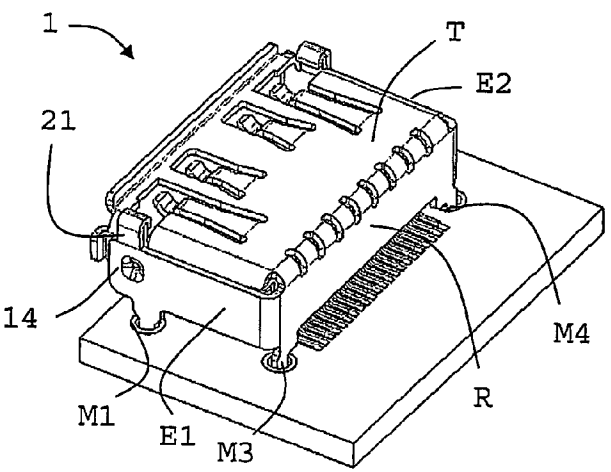
Figure 7A:
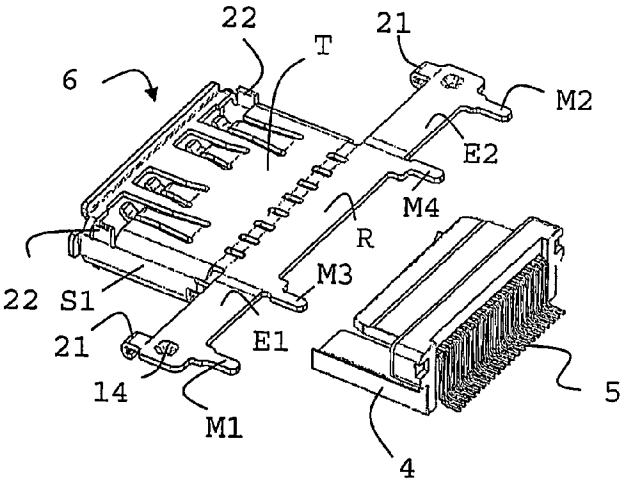
Figure 7C:
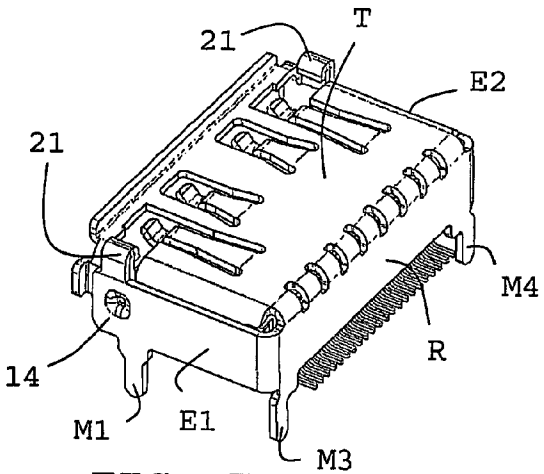

The embodiment of the invention as shown in FIGS. 6A-6D comprises sidewalls S1, S2 with locking elements 20 extending in a direction away from the sidewalls. The extensions E1, E2 comprise corresponding openings 17 capable of receiving the locking elements 20. After bending the extensions E1, E2 such that these extend substantially parallel along the corresponding sidewalls S1, S2, the locking elements 20 are aligned with and allowed to protrude through the openings 17 of the extensions E1, E2. The locking elements are forced over a portion of the extensions E1, E2 to lock the extensions E1, E2 to the shell 6, as shown in FIG. 6D.

The fourth embodiment of the invention shown in FIGS. 7A-7D resembles the first embodiment of FIGS. 3A-3C and 4A-4D. The fourth embodiment differs from the first embodiment by virtue of the absence of the opening 15 in the sidewalls S1, S2 and in that hook portions 21 are provided with the extensions E1, E2 and the sidewalls S1, S2 include corresponding hook receiving structures 22. After bending of the extensions E1, E2 over a bending angle Φ exceeding 90 degrees, and bending the rear wall R with respect to the top wall T, the hook portions 21 are automatically received and locked in the hook receiving portions 22. The hook portions 21 protrude the shell 6. However, the space available for the latches 11 is sufficient to accommodate the hook portions 21 and, consequently, no additional space is required for the present embodiment.

The embodiment of FIGS. 7A-7D provides a more secure connection of the extensions E1, E2 to the sidewalls S1, S2 in comparison with the embodiment of FIGS. 3A-3C and FIGS. 4A-4D. Moreover, the interaction of the hook portions 21 with the corresponding hook receiving structure 22 prevent lifting of the connector housing 4 accommodating the terminals 5 after the mounting posts M1, M2, M3, M4 are mounted on the circuit board 2.

The embodiments of the invention shown in FIGS. 8A-8C, FIGS. 9A-9C and FIGS. 10A-10C provide alternatives or improvements of the embodiment of FIGS. 7A-7D.

Figure 8B:
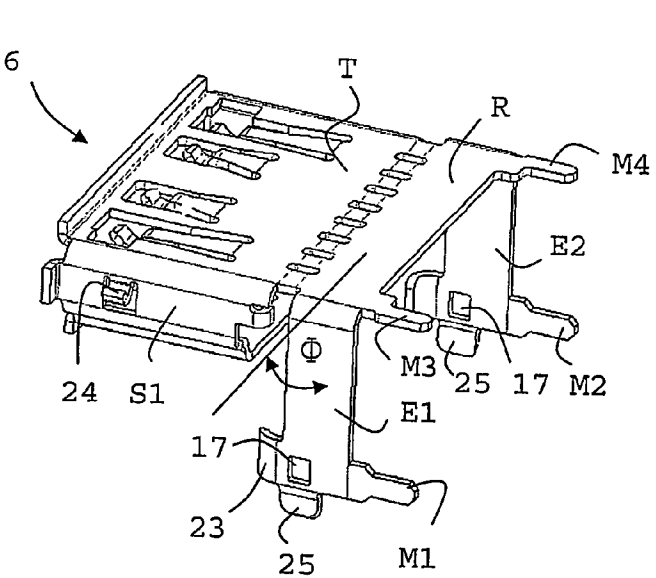
FIGS. 8A-8C show steps of a manufacturing sequence for an electrically conductive shell of a circuit board connector according to a fifth embodiment of the invention.
Figure 8A:
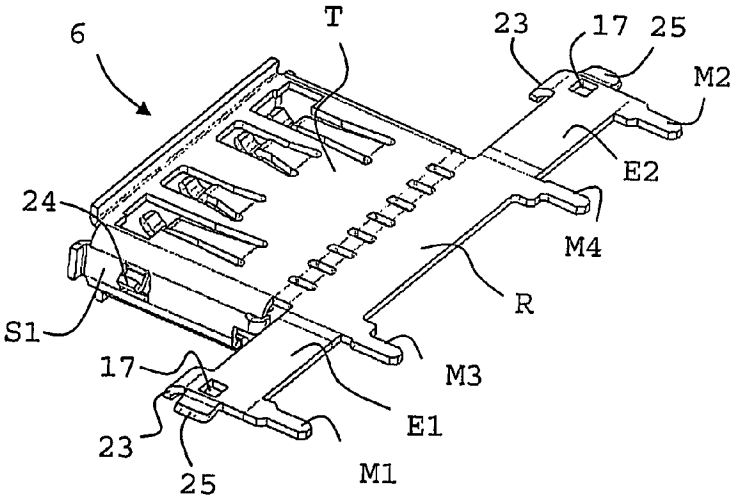
Figure 8C:
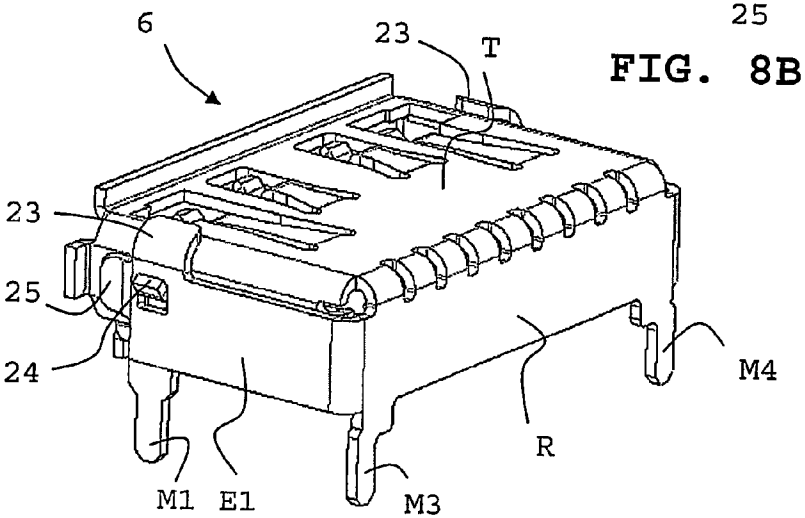
Figure 9A:
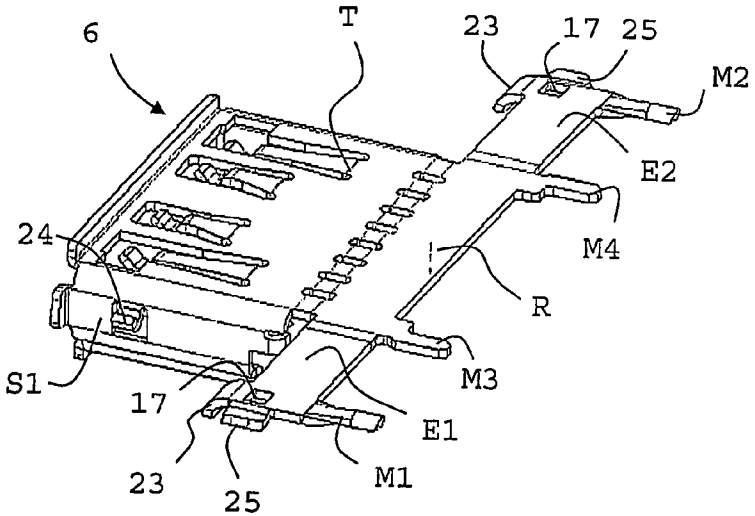
FIGS. 9A-9C show steps of a manufacturing sequence for an electrically conductive shell of a circuit board connector according to a sixth embodiment of the invention.
Figure 9B:
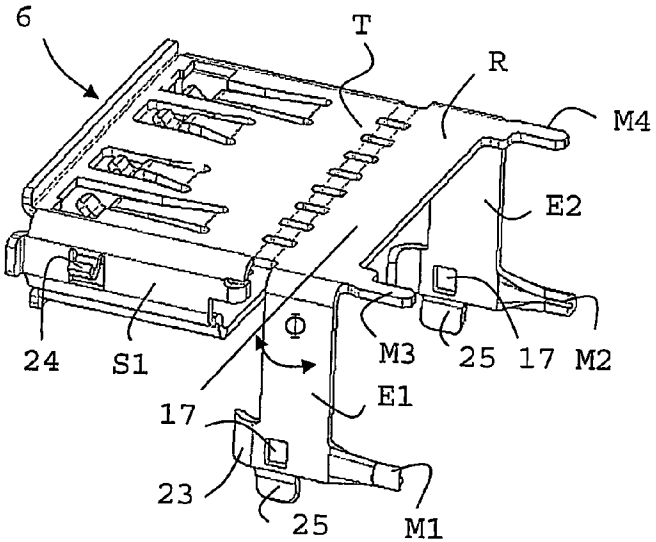
Figure 9C:
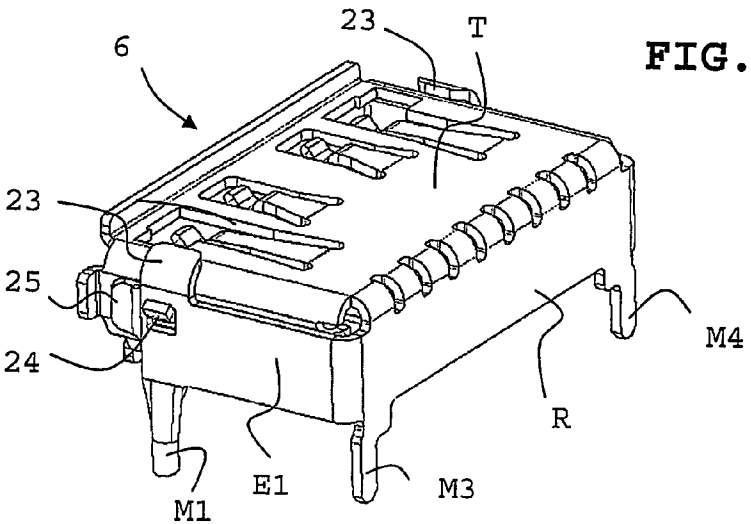

In the embodiment of FIGS. 8A-8C, the extensions E1, E2 are provided with openings 17 instead of the hook portions 21 of the previous embodiments. Furthermore, the extensions E1, E2 have curved portions 23 resting on the main body of the shell 6. The sidewalls S1, S2 comprise locking structures 24 capable of being received by the corresponding openings 17 in the extensions E1, E2. In contrast with the hook receiving structures 22 of the previous embodiment, the locking structures 24 are provided under an angle on the sidewalls S1, S2. Consequently, the openings 17 in the extensions S1, S2 may more easily receive the corresponding locking structures 24 and manufacture of the shell 6 is improved. Furthermore, the angled locking structures 24 on the sidewalls S1, S2 reduce the height of the shell 6.

Moreover, the extensions E1, E2 are provided with line contact structures 25 instead of the protrusions 14 shown in the earlier embodiments. The structures 25 provide for the establishment of a line contact between the sidewalls S1, S2 and the extensions E1, E2 instead of a point contact. In order not to damage the sidewalls S1, S2 during assembly of the shell 6, the structures 25 may be rounded or otherwise smoothened.

The embodiment of the invention as shown in FIGS. 9A-9D differs from the embodiment of FIGS. 8A-8C in the shape of the mounting posts M1-M4. Instead of flat mounting posts, the first and second mounting posts M1, M2 are curved. These curves facilitate positioning. In general, structured mounting posts may also provide polarization features for distinguishing e.g. between source and sink circuit board connectors 1 (see FIG. 1).

Figures 10A, 10B, 10C:
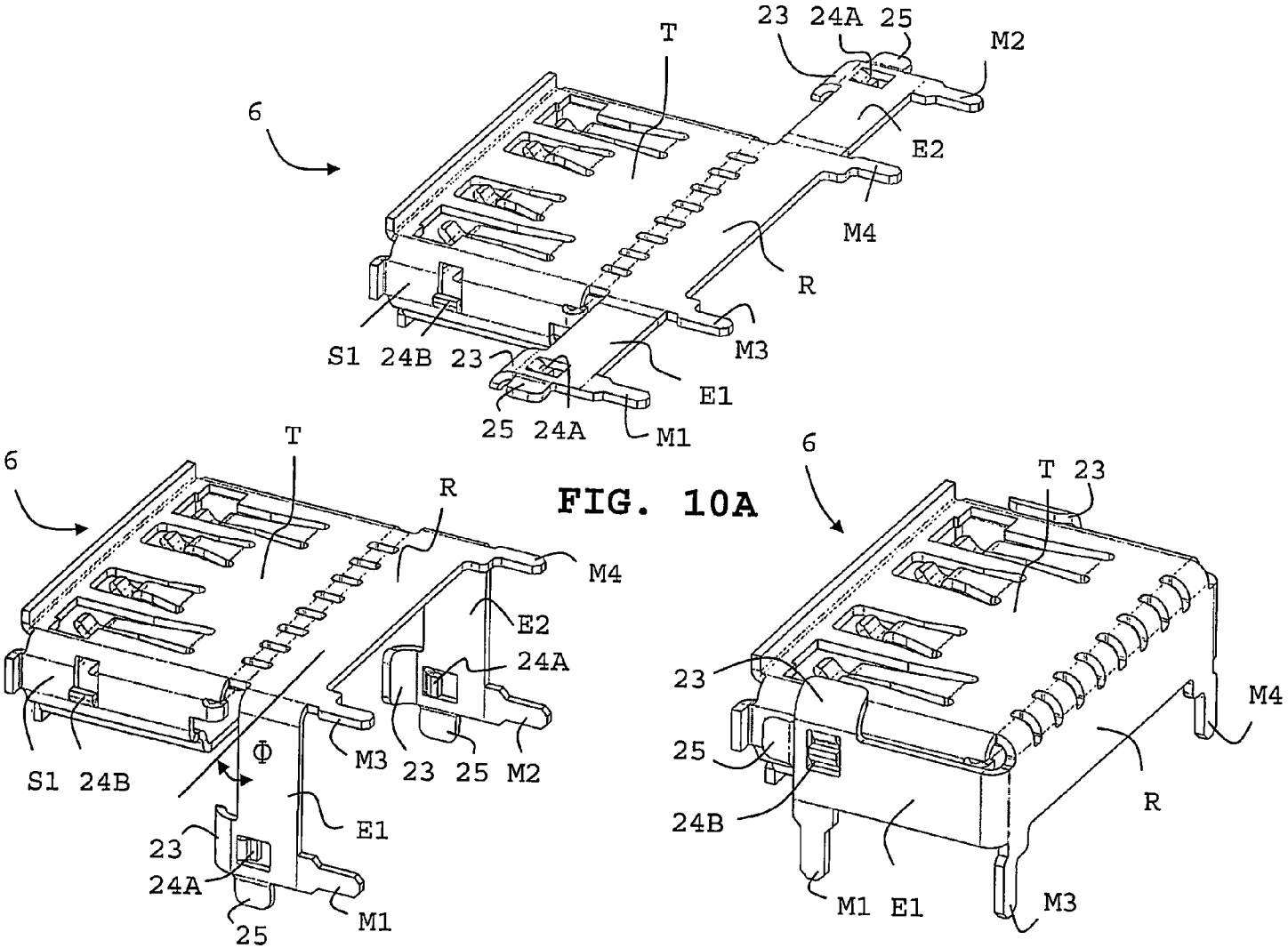
FIGS. 10A-10C show steps of a manufacturing sequence for an electrically conductive shell of a circuit board connector according to a seventh embodiment of the invention.

Finally, in FIGS. 10A-10C, alternative locking structures 24A,24B are used to facilitate locking of the extensions E1, E2 to the corresponding sidewalls S1, S2.

It should be appreciated that the invention is not limited by the above-described embodiments. For example, alternatively or in addition of the connections described above between the extensions E1, E2 and the remainder of the shell 6, the first and second extension E1,E2 may be permanently mounted to said corresponding sidewalls S1, S2, preferably by welding, soldering or gluing. Moreover, it is noted that the extensions E1, E2 and the rear wall R may comprise more than two mounting posts M1-M4. A difference in position or the amount of mounting posts may be used for polarization purposes, e.g. to distinguish source and sink circuit board connectors 1 in UDI applications. The mounting posts M1-M4 may comprise solder tails, press fit tails or surface mount tails. Furthermore, it should be appreciated that the metal plate 7 does not necessarily comprise only one metal or alloy. The metal plate 7 may comprise various metals or alloys soldered or lasered to form an integrate electrically conductive shell 6.

The invention claimed is:

1. A circuit board connector capable of establishing an electrical connection between circuits on a circuit board and a mating electrical connector at a mating side of said circuit board connector, said circuit board connector comprising a connector housing accommodating a plurality of terminals for establishing said electrical connection and an one-piece electrically conductive shell at least partially enclosing said connector housing, wherein said one-piece shell comprises:

a top wall, a bottom wall, a rear wall connected to said top wall and arranged opposite to said mating side, opposing sidewalls connected to said top wall and substantially extending in a direction between said rear wall and said mating side;

a first and second extension connected to opposite sides of said rear wall and bent with respect to said rear wall to extend towards said mating side;

first and second mounting posts connected, respectively, to said first and second extension and third and fourth mounting posts connected to said rear wall, wherein said mounting posts are arranged for mounting said shell on said circuit board.

2. The connector according to claim 1, wherein said first and second extensions extending substantially parallel to said corresponding sidewalls.

3. The connector according to claim 2, wherein at least one of said extensions is capable of interacting with at least one of said top wall and said sidewalls, preferably by means of locking structures.

4. The connector according to claim 2, wherein said first and second extension are capable of exerting a contact force towards at least one of said sidewalls and said top wall.

5. The connector according to claim 2, wherein said first and second extension comprise a protrusion and/or line contact structure extending in a direction of said corresponding sidewalls.

6. The connector according to claim 5, wherein said corresponding sidewalls each comprise an opening capable of receiving said corresponding protrusion.

7. The connector according to claim 2, wherein said first and second extension each comprise at least one integrate hook portion and at least one of said top wall and said sidewalls comprise corresponding hook receiving structures capable of receiving said hook portions.

8. The connector according to claim 7, wherein said integrate hook portions are provided on said first and second extension on a side opposite to first and second mounting posts.

9. The connector according to claim 2, wherein said first and second extension each comprise an opening or locking structure and each of said sidewalls comprises a corresponding locking structure capable of being received in said corresponding opening.

10. The connector according to claim 2, wherein said sidewalls each comprise at least one locking element capable to extend over at least a portion of said first and second extension.

11. The connector according to claim 10, wherein said locking element is capable to extend substantially from said mating side towards said rear wall and wherein said first and second extension each comprise an opening capable of receiving at least a tip portion of said corresponding locking element to contact said corresponding sidewall.

12. The connector according to claim 10, wherein said first and second extension comprise a recess at said mating side capable of receiving said locking element.

13. The connector according to claim 12, wherein said recess comprises an alignment portion and a portion capable of interacting with said locking element in said recess.

14. The connector according to claim 10, wherein said extensions each comprise an opening capable of receiving said corresponding locking element.

15. The connector according to claim 2, wherein said first and second extensions are permanently mounted to said corresponding sidewalls, preferably by welding, soldering or gluing.

16. The connector according to claim 1, wherein said first and second mounting posts are provided near said mating side at a first distance from each other and said third and fourth mounting posts are provided at a second distance from each other, said first distance exceeding said second distance.

17. The connector according to claim 1, wherein said mounting posts are substantially flat to define major surfaces for said mounting posts and wherein a first normal direction of said major surfaces of said first and second mounting posts is substantially orthogonal to a second normal direction of said major surfaces of said third and fourth mounting posts.

18. The connector according to claim 1, wherein at least one of said mounting posts comprises alignment structures.

19. The connector according to claim 1, wherein said top surface and said rear wall are interconnected by a series of substantially equidistant openings and connecting elements.

20. The connector according to claim 19, wherein said connecting elements determine a bending profile for bending said top wall and said rear wall with respect to each other.

21. An electrically conductive shell for use in a circuit board connector according claim 1.

22. A circuit board connector capable of establishing an electrical connection between circuits on a circuit board and a mating electrical connector at a mating side of said circuit board connector, said circuit board connector comprising a connector housing accommodating a plurality of terminals for establishing said electrical connection and a one-piece electrically conductive shell at least partially enclosing said connector housing, wherein said shell comprises;

a top wall, a bottom wall, a rear wall connected to said top wall and arranged opposite to said mating side, opposing sidewalls connected to said top wall and substantially extending in a direction between said rear wall and said mating side;

a first and second extension connected to opposite sides of said rear wall and bent with respect to said rear wall to extend towards said mating side substantially parallel to said corresponding sidewalls, wherein said first and second extension are capable to cooperate with at least one of said top wall and said sidewalls;

first and second mounting posts connected, respectively, to said first and second extension and third and fourth mounting posts connected to said rear wall, wherein said mounting posts are arranged for mounting said shell on said circuit board.

23. A circuit board connector capable of establishing an electrical connection between circuits on a circuit board and a mating electrical connector at a mating side of said circuit board connector, said circuit board connector comprising a connector housing accommodating a plurality of terminals for establishing said electrical connection and a one-piece electrically conductive shell at least partially enclosing said connector housing, wherein said shell comprises:

a top wall, a bottom wall, a rear wall connected to said top wall and arranged opposite to said mating side, opposing sidewalls connected to said top wall and substantially extending in a direction between said rear wall and said mating side;

a first and second extension connected to opposite sides of said rear wall and bent with respect to said rear wall to extend towards said mating side substantially parallel to said corresponding sidewalls, wherein said first and second extension are capable to cooperate with at least one of said top wall and said sidewalls;

first and second mounting posts connected, respectively, to said first and second extension and third and fourth mounting posts connected to said rear wall, wherein said mounting posts are arranged for mounting said shell on said circuit board, wherein said mounting posts are substantially flat to define major surfaces for said mounting posts and wherein a first normal direction of said major surfaces of said first and second mounting posts is substantially orthogonal to a second normal direction of said major surfaces of said third and fourth mounting posts.

24. A method of manufacturing a one-piece electrically conductive shell comprising a top wall, a bottom wall, opposing sidewalls and a rear wall, wherein said sidewalls and said rear wall are connected to said top wall and a first and second extension are connected to opposite sides of said rear wall and wherein said first and second extension comprise a first and second mounting post and said rear wall comprises third and fourth mounting posts for mounting said shell on a circuit board, said method comprising the steps of:

bending said top wall and rear wall with respect to each other such that said rear wall is oriented substantially orthogonal to said top wall, and bending said first and second extension with respect to said rear wall such that said first and second extension are capable of extending along said sidewalls.

25. The method according to claim 24, wherein said sidewalls each comprise at least one locking element, further comprising the step of manipulating said locking element such that said locking element extends over at least a corresponding portion of said first and second extension.

26. The method according to claim 24, further comprising the step of mounting said first and second extensions to said corresponding sidewalls by welding, soldering or gluing.

27. The method according to claim 24, wherein said shell comprises a bending profile for bending said top wall and rear wall with respect to each other, further comprising the step of bending said top wall and rear wall with respect to each other along said bending profile.

28. A method of manufacturing a one-piece electrically conductive shell comprising a top wall, a bottom wall, opposing sidewalls and a rear wall, wherein said sidewalls and said rear wall are connected to said top wall and a first and second extension are connected to opposite sides of said rear wall and wherein said first and second extension comprise a first and second mounting post and said rear wall comprises third and fourth mounting posts for mounting said shell on a circuit board, said method comprising the steps of:

bending said first and second extension with respect to said rear wall such that said first and second extensions are capable of exerting a contact force towards said sidewalls;

bending said top wall and rear wall with respect to each other such that said rear wall is oriented substantially orthogonal to said top wall.

29. The method according to claim 28, wherein said first and second extension comprise hook portions and at least one of said top wall and sidewalls comprise hook receiving structures capable of receiving said hook portions, said method further comprising the step of manipulating said first and second extension such that said hook portions cooperate with said corresponding hook receiving structures.

* * * * *